United States Patent [19]

Elsasser et al.

[11] 4,003,558

[45] Jan. 18, 1977

[54] SUPPORTING STRUCTURE FOR BLAST FURNACES

[75] Inventors: Harold B. Elsasser, Mount Lebanon Township, Allegheny County; James F. Gunion, McCandless Township, Allegheny County; Melvin L. Huerter; Andrew L. Poulos, both of Upper St. Clair Township, Allegheny County, all of Pa.

[73] Assignee: United States Steel Corporation, Pittsburgh, Pa.

[22] Filed: Apr. 7, 1976

[21] Appl. No.: 674,353

[52] U.S. Cl. ..... 266/198

[51] Int. Cl.[2] ..... C21B 7/00

[58] Field of Search ..... 266/142, 143, 195–199; 52/223

[56] References Cited

UNITED STATES PATENTS 3,431,691 3/1969 Greaves et al. ..... 266/198

*Primary Examiner*—Gerald A. Dost

*Attorney, Agent, or Firm*—Walter P. Wood

[57] ABSTRACT

A supporting structure for a blast furnace in which the mantle and stack are supported on columns spaced a substantial distance from the furnace. Trusses and girders span the spaces between columns. The girders carry a frame which surrounds the furnace above the mantle. Hangers are suspended from the frame and girders and connected to the mantle. The supporting structure has advantages that it allows more room for maintenance of the furnace, and that there is little likelihood of damage to the columns in the event of a burnout.

10 Claims, 5 Drawing Figures

SUPPORTING STRUCTURE FOR BLAST FURNACES

This invention relates to an improved supporting structure for a blast furnace.

The invention may be looked on as an improvement over the supporting structures shown in Greaves et al U.S. Pat. Nos. 3,431,691, 3,559,972, 3,630,507, 3,733,065 and 3,786,606, the disclosures of which are incorporated herein by reference. These patents describe in detail conventional structures used for supporting blast furnaces and the problems which are encountered. The structures shown in the patents overcome certain of these problems, but one problem which remains is the lack of free space within the cast house adjacent to the furnace hearth. The proximity of supporting columns or legs to the iron notch and cinder notch, if used, leads to congestion and hampers the casting operation. Runners for handling iron and slag tapped from the furnace must be accommodated within the space bounded by the columns or legs. When space is restricted, maintenance is difficult and costly, since there is no room to accommodate overhead cranes close to the furnace. If there is a burnout, columns or legs near the furnace are likely to be damaged. In practice the supporting structures shown in the Greaves et al patents include four legs which are designed to enable any three to support the furnace if one is lost. This of course necessitates making the legs heavier than otherwise required and adds to the cost.

An object of our invention is to provide an improved supporting structure for a blast furnace in which we overcome the foregoing problems, that is, in which we support the furnace on columns located a substantial distance from the furnace and overhead trusses and girders spanning the spaces between the columns.

A further object is to provide a furnace supporting structure which affords the foregoing advantage and in which we suspend the mantle and stack from an improved arrangement of hangers to impart stability, yet allow for necessary lateral movement brought about by thermal expansion.

A further object is to provide an improved means for attaching and adjusting the hangers to level the mantle.

Figure 1:
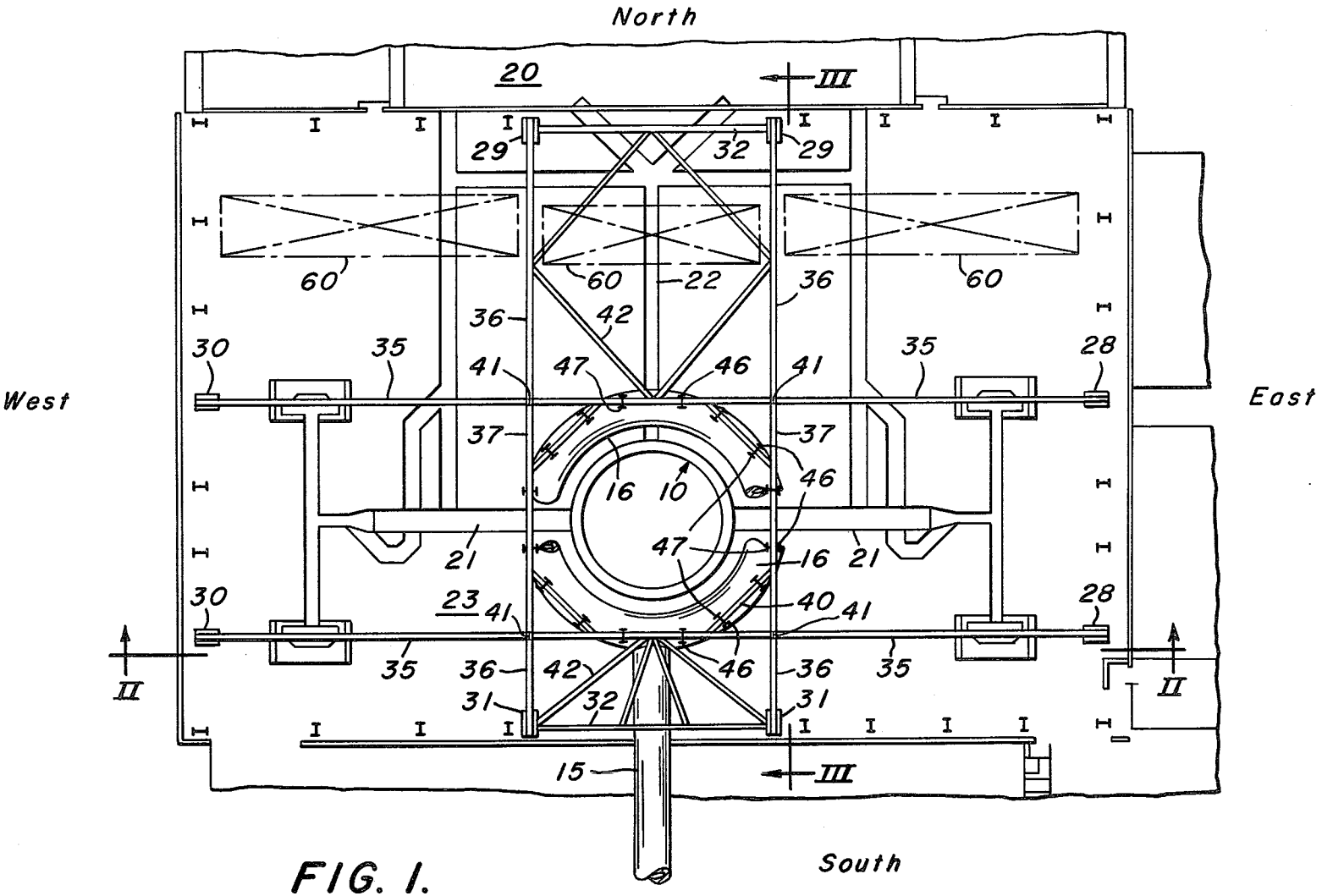
FIG. 1 is a diagrammatic layout of a blast furnace and supporting structure therefor constructed in accordance with our invention.
Figure 2:
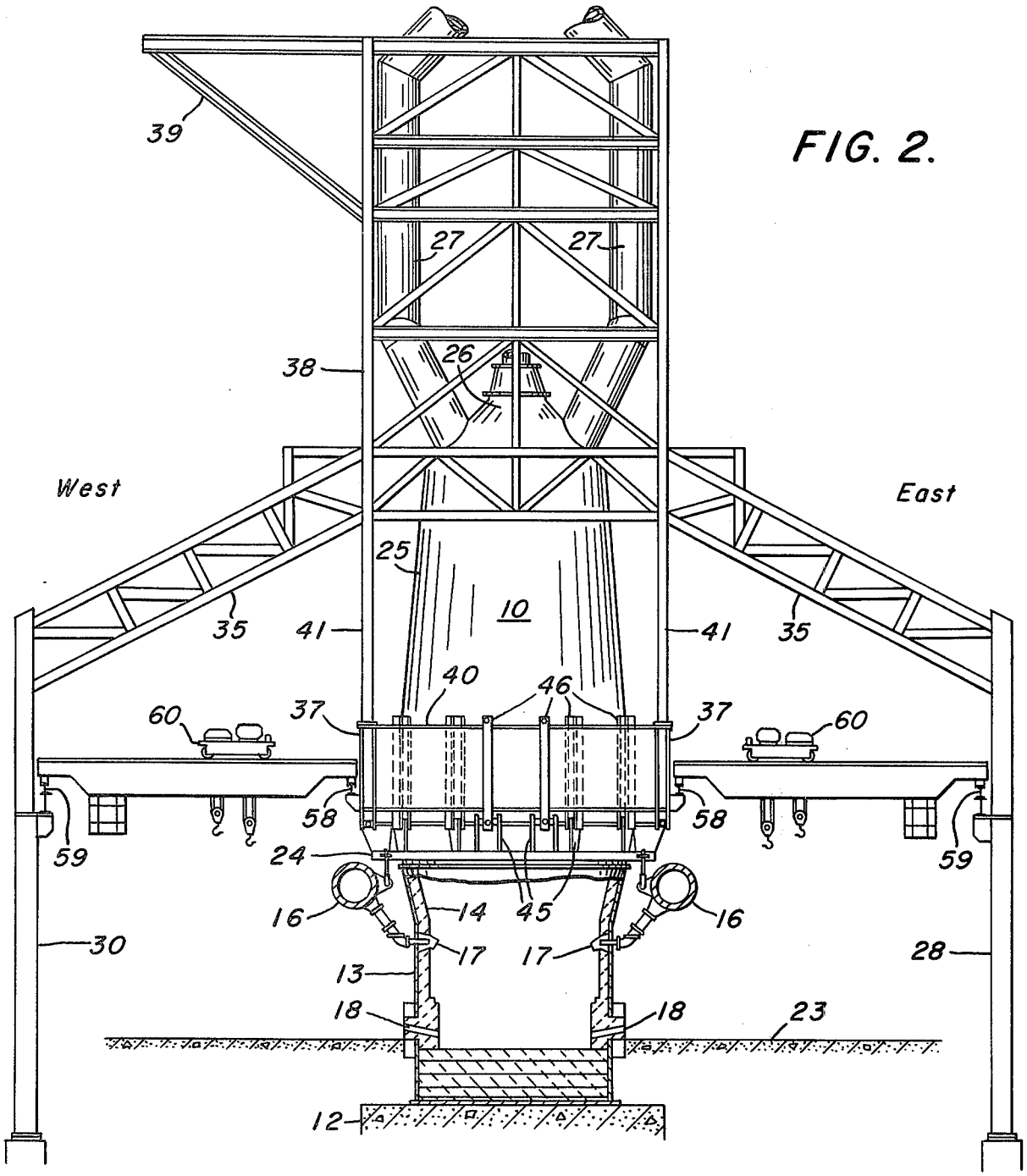
FIG. 2 is a vertical section on line II—II of FIG. 1 simplified by omission of parts not needed for an understanding of the invention.
Figure 3:
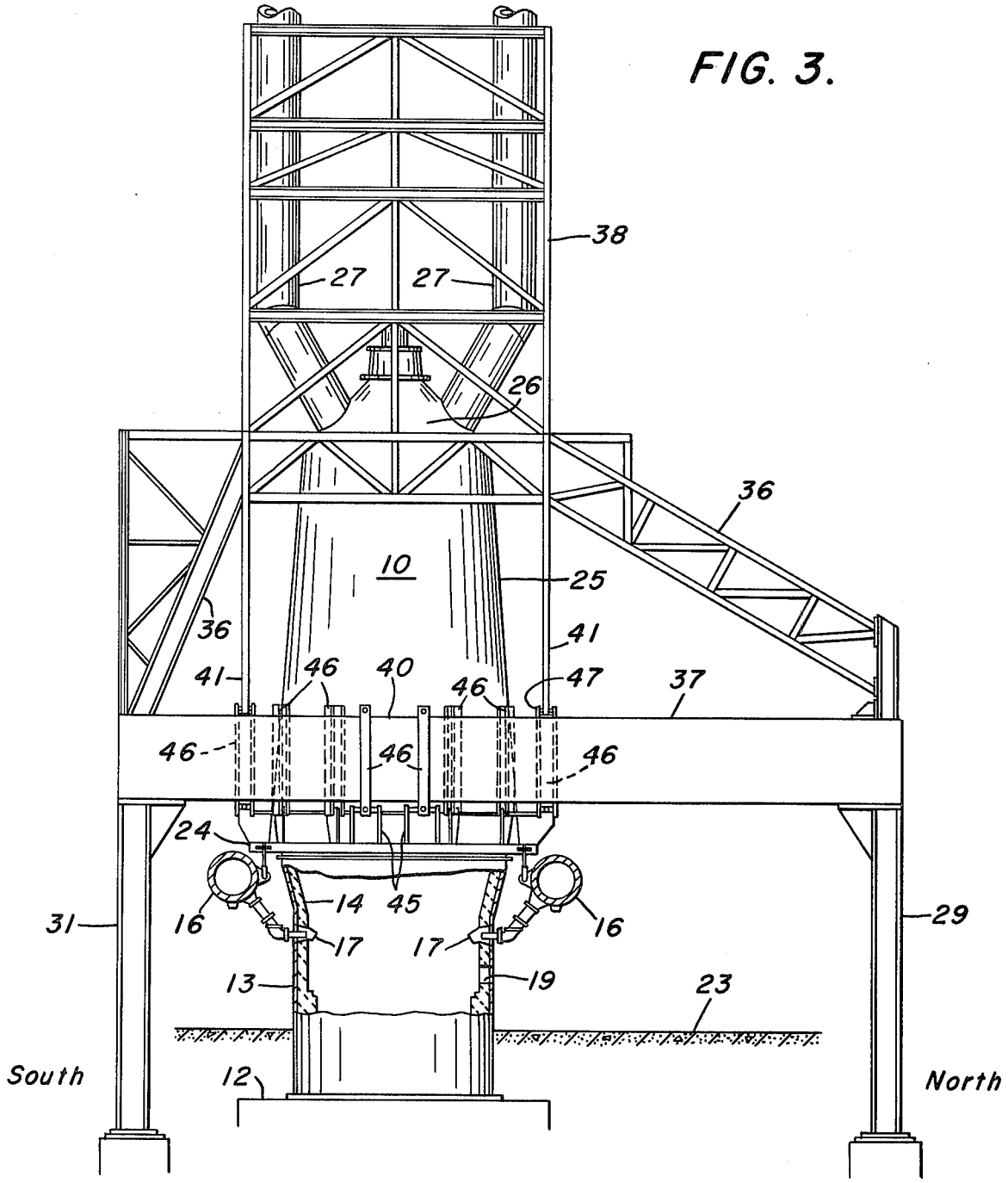
FIG. 3 is a vertical section on line III—III of FIG. 1 likewise simplified.

FIGS. 1, 2 and 3 show a blast furnace 10, which may be conventional apart from our supporting structure. As best shown in FIGS. 2 and 3, the lower portion of the furnace is supported on the usual foundation 12. The parts supported on the foundation include a hearth 13 and a bosh 14. The furnace has the usual hot blast main 15 leading from stoves (not shown), bustle pipe 16, tuyeres 17, iron and cinder notches 18 and 19 and slag pits 20. Iron runners are indicated at 21 and a slag runner at 22. The cast house floor is indicated at 23. The supporting structure of our invention, hereinafter described, supports the parts of the furnace above the bosh. These parts include a mantle 24, a stack 25, and a dome 26 through which materials are charged to the furnace. The furnace has uptakes 27 leading from the dome. Other parts of the furnace are not shown, since they are not involved in our invention.

For convenience in the description which follows, we refer to the points of the compass in designating the sides of the furnace, but this designation of course does not limit our invention. Our supporting structure includes a pair of east columns 28, a pair of north columns 29, a pair of west columns 30, and a pair of south columns 31. An important feature is that all the columns are straight and extend vertically. The columns on each side are connected by suitable bracing 32 (FIG. 1). The north, east and west columns are located a substantial distance away from the furnace. Preferably the vertical plane of each pair of columns is located at least 90 to 100 feet from the center line of the furnace. The south columns 31, which are on the side toward the stoves and hot blast main 15, may be closer to the furnace, if necessitated by the plant layout, but their plane should be at least 40 to 50 feet from the center line. At the level of the cast house floor 23, the columns nearest the furnace should be spaced from the center of the hearth by a distance of at least twice the hearth radius.

A pair of east-west trusses 35 span the space between opposite east-west columns 28 and 30, and are supported to their ends on these columns (FIG. 2). One of these trusses lies north of the furnace; the other lies south. A pair of north-south trusses 36 span the space between the north and south columns 29 and 31 and are supported at their ends on these columns (FIG. 3). A pair of main support girders 37 span the space between the north and south columns 29 and 31 beneath the trusses 36 and likewise are supported at their ends on these columns. One of the trusses 36 and one of the girders 37 lie east of the furnace; the other truss and girder west. The four trusses 35 and 36 reach an elevation approximately even with the top of the furnace stack 25 and are interconnected at their four intersections. A top structure 38 extends upwardly from the trusses to stabilize the uptakes 27, to support a series of maintenance platforms (not shown), and to provide a support 39 for a top maintenance crane. The main girders 37 lie at an elevation several inches above the mantle 24 and form two sides of a polygonal frame 40, preferably octagonal, which surrounds the furnace (FIG. 1). Four vertically extending tension members 41 are connected at their ends to the trusses 35 and 36 and to the octagonal frame 40 to afford additional support for the latter. Horizontal bracing 42 interconnects the girders and frame north and south of the furnace.

Fixed to the mantle 24 are a plurality of pairs of upwardly and outwardly projecting bracket plates 45. When frame 40 is octagonal as illustrated, there are two pairs of bracket plates located beneath each side of the octagon. Outer and inner hangers 46 and 47 are suspended from the sides of frame 40 above each pair of bracket plates. The lower ends of the hangers are attached to the bracket plates, whereby girders 37 and columns 28, 29, 30 and 31 afford the full support for the mantle 24 and all parts thereabove.

Figure 5:
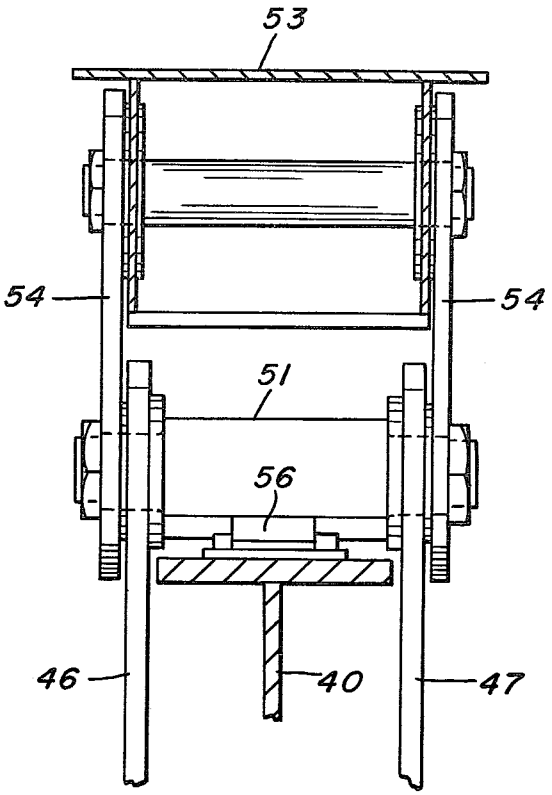
FIG. 5 is a vertical section on line V—V of FIG. 4.
Figure 4:
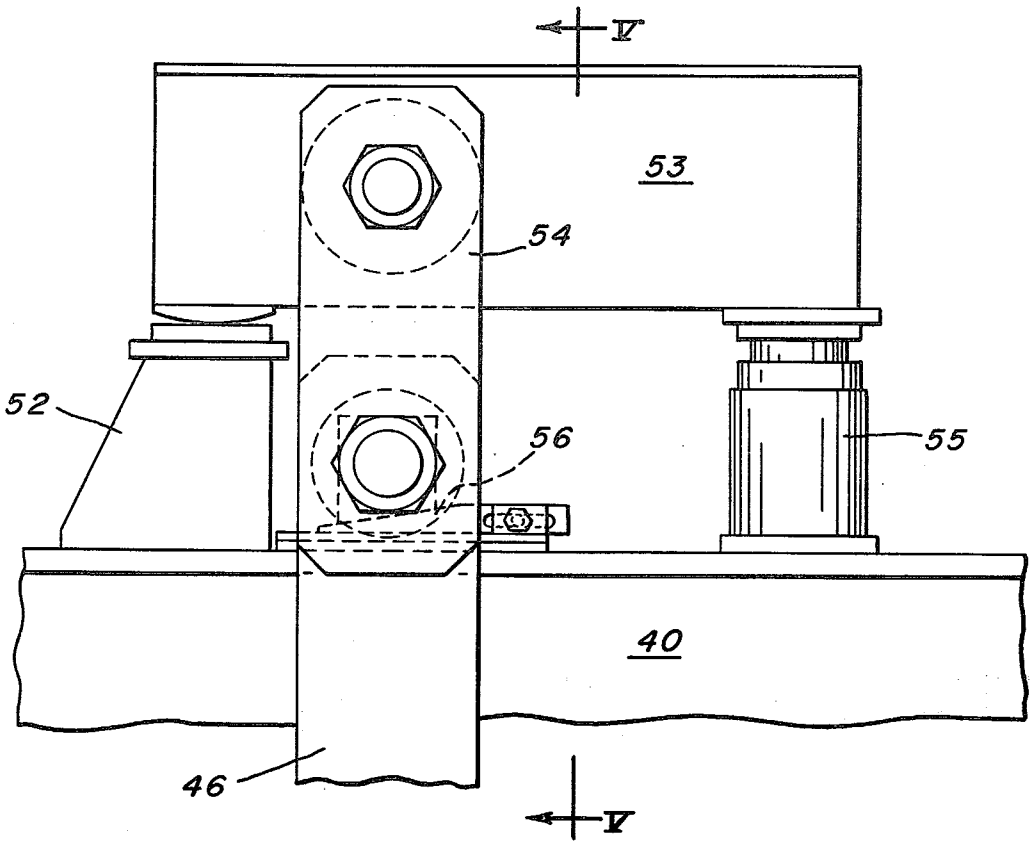
FIG. 4 is a side elevational view on a larger scale illustrating the preferred means for attaching the hangers embodied in the structure to the frame.

The mantle 24 must be supported in a level position and the load on the various hangers 46 and 47 should be uniform. FIGS. 4 and 5 show our preferred means for attaching a set of hangers 46 and 47 to the frame 40 to achieve uniform loading and leveling the mantle. The upper ends of the hangers are attached to a block 51 which extends across the upper flange of the frame. A jacking pedestal 52 is fixed to this flange adjacent the block. When installing the hangers, we temporarily apply a jacking assembly which includes a beam 53 and a pair of links 54 pivoted to the beam and depending therefrom. The beam is fulcrumed at one end on the top of pedestal 52. The lower ends of the links are pivoted to the ends of block 51. We place a conventional jack 55 under the other end of the beam and use the jack to lift the hangers to a position in which the mantle is level. We place wedges 56 between the block 51 and the top of the frame to hold the mantle in its leveled position. We can apply the jacks to all sets of hangers at the same time, and use the jacks to equalize the loads among the hangers around the full circumference of the furnace. When all the wedges are in place and secured, we remove the jacking assemblies and jacks.

From the foregoing description it is seen that the present invention affords a blast furnace supporting structure which allows ample free space within the cast house. As shown in FIGS. 2 and 3, we can mount trackways 58 and 59 on the girders 37 and the various columns for service cranes 60 which operate between the columns and the girders and between the girders. These cranes can move in close to the furnace, thus facilitating and expediting maintenance. Since the columns are spaced a substantial distance from the furnace, there is little likelihood of their being damaged in the event of a burnout.

We claim:

1. The combination, with a blast furnace which includes a mantle and a stack supported on said mantle, of an improved supporting structure for said mantle and said stack, said structure comprising a plurality of columns spaced a substantial distance from said furnaces and arranged in a pattern therearound, trusses supported on said columns and spanning the spaces therebetween outside said furnace, a pair of girders supported on certain of said columns and spanning the spaces therebetween beneath said trusses, a frame carried by said girders surrounding said furnace above said mantle, tension members connecting said trusses and said frame, and hangers suspended from said frame and connected to said mantle.

2. A combination as defined in claim 1 in which said columns are arranged with two columns on each of four sides of said furnace.

3. A combination as defined in claim 2 in which there are four trusses, two of which span the spaces between two columns at one side of the furnace and two columns at the opposite side, and the other two trusses span the spaces between two columns at one of the remaining sides and two columns at the other remaining side.

4. A combination as defined in claim 1 in which said columns are straight and vertical.

5. A combination as defined in claim 1 in which said mantle carries upwardly and outwardly extending bracket plates fixed thereto, and said hangers are connected to said bracket plates.

6. A combination as defined in claim 1 comprising in addition means on said frame for adjusting said hangers to level said mantle and equalize the loads on the hangers.

7. A combination as defined in claim 6 in which said adjusting means include a block above said frame to which said hangers are attached, jacking means for adjusting the position of said block relative to said frame, and wedge means inserted between said block and said frame.

8. A combination as defined in claim 1 in which said furnace includes a dome and uptakes above said stack, and said supporting structure comprises in addition a top structure extending upwardly from said frame around said dome and uptakes.

9. A combination as defined in claim 8 in which said uptakes are wholly inside said top structure.

10. A combination as defined in claim 1 further comprising at least one overhead trackway in the space between said columns and said girders, and a service crane mounted on said trackway.

* * * * *